US011674710B2

(12) United States Patent
Terraz

(10) Patent No.: US 11,674,710 B2
(45) Date of Patent: Jun. 13, 2023

(54) AIR COOLED CHILLER HYDRONIC KIT

(71) Applicant: Carrier Corporation, Palm Beach Gardens, FL (US)

(72) Inventor: Gregory Terraz, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/547,706

(22) Filed: Dec. 10, 2021

(65) Prior Publication Data

US 2022/0099328 A1 Mar. 31, 2022

Related U.S. Application Data

(63) Continuation of application No. 16/091,900, filed as application No. PCT/US2017/026665 on Apr. 7, 2017, now Pat. No. 11,262,096.

(60) Provisional application No. 62/319,343, filed on Apr. 7, 2016.

(51) Int. Cl.

| | |
|---|---|
| ***F24F 11/84*** | (2018.01) |
| ***F24F 11/30*** | (2018.01) |
| *F24F 110/12* | (2018.01) |
| *F24F 110/40* | (2018.01) |
| *F24F 140/20* | (2018.01) |
| *F24F 11/43* | (2018.01) |
| *F24F 110/20* | (2018.01) |

(52) U.S. Cl.

CPC ..... *F24F 11/84* (2018.01); *F24F 11/30* (2018.01); *F24D 2220/0278* (2013.01); *F24F 11/43* (2018.01); *F24F 2110/12* (2018.01); *F24F 2110/20* (2018.01); *F24F 2110/40* (2018.01); *F24F 2140/20* (2018.01)

(58) Field of Classification Search

CPC .. F24F 11/84; F24F 11/30; F24F 11/43; F24F 2110/12; F24F 2110/20; F24F 2110/40; F24F 2140/20; F24F 5/0003; F24D 2220/0278

See application file for complete search history.

(56) References Cited

U.S. PATENT DOCUMENTS

| | | | |
|---|---|---|---|
| 3,844,131 | A | 10/1974 | Stillson et al. |
| 4,223,537 | A | 9/1980 | Sanborn et al. |
| 4,308,042 | A | 12/1981 | Ecker |
| 6,449,973 | B2 | 9/2002 | Dodge et al. |

(Continued)

FOREIGN PATENT DOCUMENTS

| | | | |
|---|---|---|---|
| CN | 2581768 | Y | 10/2003 |
| CN | 200946710 | Y | 9/2007 |

(Continued)

OTHER PUBLICATIONS

Chinese Office Action CN 201780024697.8, dated Apr. 3, 2020, 13 pages.

(Continued)

*Primary Examiner* — Ana M Vazquez
(74) *Attorney, Agent, or Firm* — Cantor Colburn LLP

(57) ABSTRACT

A compliant containment device for use in a hydronic system, the compliant containment device including a vessel including an inlet and an outlet, and valve operably coupled to at least one of the inlet and outlet, wherein the valve is configured to operate between an open and closed position based in part on a temperature.

8 Claims, 2 Drawing Sheets

(56) References Cited

U.S. PATENT DOCUMENTS

| | | | | |
|---|---|---|---|---|
| 6,539,735 | B1 | 4/2003 | Schmidt | |
| 7,010,927 | B2 * | 3/2006 | Lifson | F25B 45/00 62/149 |
| 7,832,217 | B1 | 11/2010 | Reich et al. | |
| 10,132,539 | B2 * | 11/2018 | Sugimoto | F25B 25/005 |
| 2009/0314014 | A1 | 12/2009 | Ericsson | |
| 2010/0154438 | A1 | 6/2010 | Bean, Jr. | |
| 2012/0180997 | A1 | 7/2012 | Johnston et al. | |
| 2014/0076305 | A1 | 3/2014 | Jackman | |
| 2015/0345846 | A1 | 12/2015 | Kopko et al. | |
| 2015/0377532 | A1 * | 12/2015 | Uselton | F25B 49/02 62/149 |
| 2019/0113249 | A1 | 4/2019 | Terraz | |

FOREIGN PATENT DOCUMENTS

| | | | |
|---|---|---|---|
| CN | 201177332 | Y | 1/2009 |
| CN | 201396893 | Y | 2/2010 |
| CN | 201740325 | U | 2/2011 |
| CN | 102155472 | A | 8/2011 |
| CN | 202648229 | U | 1/2013 |
| CN | 203501580 | U | 3/2014 |
| CN | 103696855 | A | 4/2014 |
| CN | 103808524 | A | 5/2014 |
| CN | 104729033 | A | 6/2015 |
| CN | 105135772 | A | 12/2015 |
| CN | 204853743 | A | 12/2015 |
| CN | 205014552 | U | 2/2016 |
| DE | 2021487 | A1 | 11/1971 |
| JP | 2001193952 | A | 7/2001 |
| JP | 2014016090 | A | 1/2014 |

OTHER PUBLICATIONS

International Search Report and Written Opinion for application PCT/US2017/026665, dated Apr. 7, 2016, 17 pages.

* cited by examiner

AIR COOLED CHILLER HYDRONIC KIT

CROSS REFERENCE TO RELATED APPLICATION

This application is a continuation of U.S. patent application Ser. No. 16/091,900, filed Oct. 5, 2018, which is a 371 National Stage Application of PCT/US2017/026665 filed Apr. 7, 2017, which claims the benefit of U.S. Provisional Application No. 62/319,343, filed Apr. 7, 2016, the entire contents of which are incorporated herein by reference.

TECHNICAL FIELD

The presently disclosed embodiments generally relate to refrigeration systems, and more particularly, to an air cooled chiller hydronic kit.

BACKGROUND

In certain installations, hydronic kits (i.e., pump, expansion tank, valve, accessories, etc.) are used with chillers. In such applications, the expansion tank is typically connected in parallel to the main water circuit. The expansion tank typically contains insulation and electrical heaters to protect the water contained therein and the conduits associated therewith from freezing due to ambient temperature and airflow around the expansion tank.

SUMMARY

In one aspect, a chiller is provided. The chiller includes a cooling fluid loop including a flow stream, a containment circuit in fluid communication with the cooling fluid loop, the containment circuit including a compliant containment device including an inlet, an outlet, and a containment volume in pressure communication with the flow stream, and wherein the containment volume changes based in part on a temperature of the flow stream.

In one embodiment, the compliant containment device further includes a valve in fluid communication with at least one of the inlet and the outlet, the valve configured to operate between an open and closed position based in part on the temperature of the flow stream.

In one embodiment, the valve includes a thermostatic valve. In one embodiment, the containment circuit further includes a temperature sensing device in fluid communication with the inlet; the temperature sensing device configured to measure temperature data, and a solenoid operably coupled to the temperature sensing device and the valve, wherein the solenoid is configure to operate the valve based in part on the temperature data.

In an embodiment, the compliant containment device further includes an insulation material disposed in a location including at least one of within and around the compliant containment device.

In an embodiment, the cooling fluid loop includes a pumping device configured to circulate the flow stream, the pumping device in fluid communication with the outlet, and a heat exchanger in fluid communication with the pumping device and the inlet.

In one aspect, a compliant containment device for use in a hydronic system is provided. The compliant containment device includes a vessel including an inlet and an outlet, and a valve operably coupled to at least one of the inlet and outlet, wherein the valve is configured to operate between an open and closed position based in part on a temperature. In an embodiment, the temperature includes at least one of an ambient temperature and a temperature within a containment circuit flow stream. In an embodiment, the valve includes a thermostatic valve. In an embodiment, the compliant containment device further includes a solenoid operably coupled to the valve, and a temperature sensing device operably coupled to the solenoid, the temperature sensing device configured to measure temperature data, and wherein the solenoid is configure to operate the valve based in part on the temperature data.

In an embodiment, the compliant containment device further includes an insulation material disposed in a location comprising at least one of within and around the compliant containment device. insulation material disposed within or around the vessel.

In one aspect, a method of operating an compliant containment device in fluid communication with a cooling fluid loop, the compliant containment device comprising a vessel including an inlet, an outlet, and a valve in fluid communication with at least one of the inlet and outlet is provided. The method including flowing a stream of water through the inlet and the outlet maintaining the stream of water above a temperature threshold.

In an embodiment, flowing a stream of water through the inlet and the outlet includes measuring a temperature of the stream of water, determining whether the temperature of the stream of water is less than or equal to the temperature threshold, and operating the valve in an open position if the temperature of the stream of water is less than or equal to the temperature threshold. In an embodiment, the temperature threshold is approximately 37 degrees Fahrenheit.

DETAILED DESCRIPTION

Figure 1:
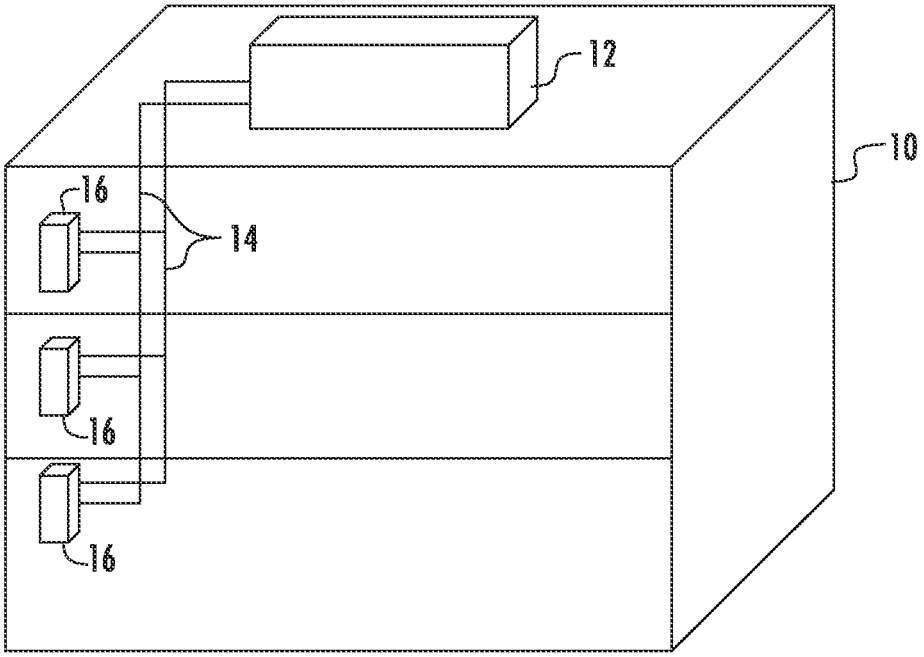
FIG. 1 illustrates a schematic diagram of a refrigeration system according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Additional materials, such as insulation and electrical heaters, increase costs of the kit, in addition to additions in assembly costs, and loss of efficiency. There is therefore a need for an expansion tank that may prevent freezing of the water contained therein and the conduits associated therewith without the additional material costs.

FIG. 1 depicts an exemplary application for a refrigeration system. Such systems, in general, may be applied in a range of settings, both within the HVAC&R field and outside of that field. The refrigeration systems may provide cooling to data centers, electrical devices, freezers, coolers, or other environments through vapor-compression refrigeration, absorption refrigeration, or thermoelectric cooling. In presently contemplated applications, however, refrigeration systems may be used in residential, commercial, light industrial, industrial, and in any other application for heating or cooling a volume or enclosure, such as a residence, building, structure, and so forth. Moreover, the refrigeration systems may be used in industrial applications, where appropriate, for basic refrigeration and heating of various fluids.

Figure 2:
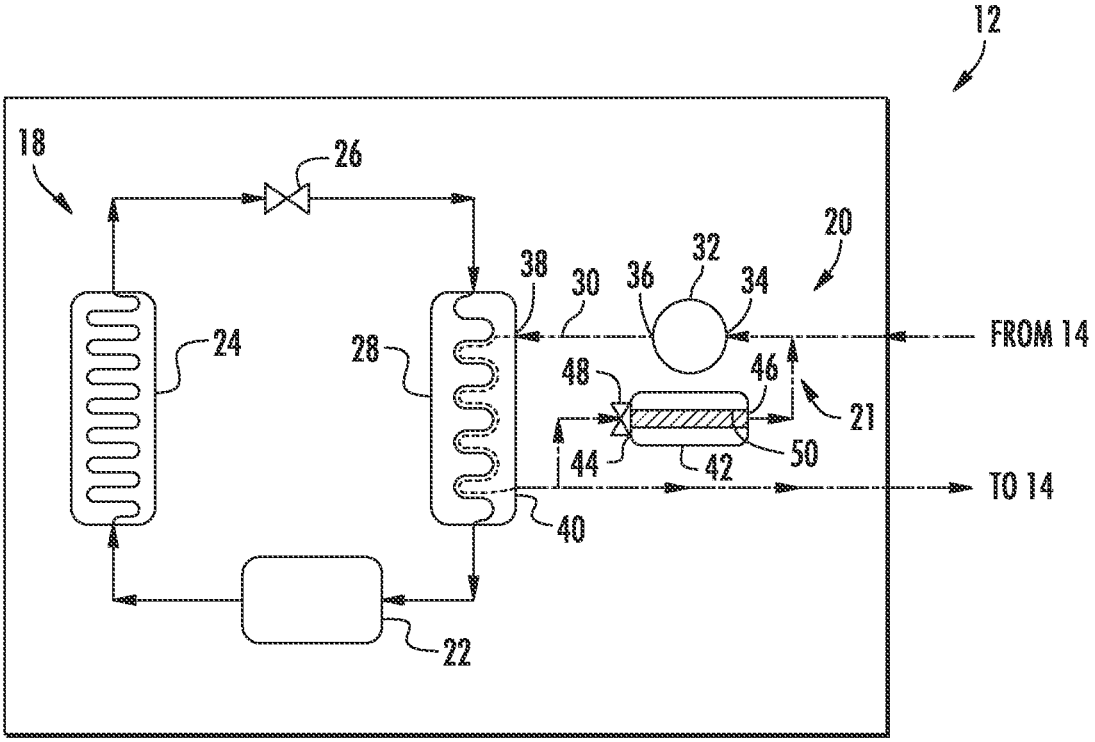
FIG. 2. illustrates a schematic diagram of a chiller according to one embodiment of the present disclosure.

FIG. 1 illustrates an exemplary application, in this case an HVAC&R system for building environmental management that may employ heat exchangers. A building 10 is cooled by a system that includes a chiller 12. As shown, chiller 12 is disposed on the roof of building 10; however, the chiller may be located in other equipment rooms or areas next to the building. Chiller 12 is an air cooled device that implements a refrigeration cycle (as shown in FIG. 2) to cool water. Chiller 12 is housed within a single structure that includes a refrigeration circuit and associated equipment such as pumps, valves, and piping. For example, chiller 12 may be a single package rooftop unit. The water from chiller 12 is circulated through building 10 by water conduits 14. Water conduits 14 are routed to air handlers 16, which may be located on individual floors and within sections of building 10.

Air handlers 16 are coupled to ductwork (not shown) that is adapted to distribute air between the air handlers 16 and may receive air from an outside intake (not shown). Air handlers 16 include heat exchangers that circulate cold water from chiller 12 to provide cooled air. Fans, within air handlers 16, draw air through the heat exchangers and direct the conditioned air to environments within building 10, such as rooms, apartments, or offices, to maintain the environments at a designated temperature. A control device (not shown), such as a thermostat, may be used to designate the temperature of the conditioned air. The control device may also be used to control the flow of air through and from air handlers 16. Other devices may, of course, be included in the system, such as control valves that regulate the flow of water and pressure and/or temperature transducers or switches that sense the temperatures and pressures of the water, the air, and so forth. Moreover, control devices may include computer systems that are integrated with or separate from other building control or monitoring systems, and even systems that are remote from the building 10.

FIG. 2 schematically depicts an embodiment of chiller 12. The chiller 12 includes a refrigerant loop 18, a cooling fluid loop 20, and a containment circuit 21 in fluid communication with the cooling fluid loop 20. Within the refrigerant loop 18, a compressor 22 operates to circulate a working fluid through a first heat exchanger 24. The working fluid may be a refrigerant, for example the refrigerant may be a hydrofluorocarbon (HFC) based R-410A, R-407C, or R-134a, or it may be carbon dioxide (R-744) or ammonia (R-717) or hydrofluoroolefin (HFO) based. The compressor 22 increases the pressure of the working fluid causing the working fluid to change to a superheated vapor. The superheated vapor is passed through the first heat exchanger 24, where it rejects heat to the environment. After passing through the first heat exchanger 24, the working fluid becomes a saturated liquid. This liquid is throttled through an expansion valve 26 where it flashes to a liquid and vapor mixture. This mixture is subsequently passed through a second heat exchanger 28 where it absorbs heat from the primary water flow, thus reducing the temperature of primary chiller water supply 30 for use in cooling the building 10. As the working fluid absorbs heat, it becomes a saturated vapor, and the cycle repeats.

The cooling fluid loop 20 includes a pumping device 32, including a pump inlet 34 and a pump outlet 36. The primary chiller water supply enters the pumping device 32 via the pump inlet 34 and exits via the pump outlet 36 and enters the second heat exchanger 28 via a heat exchanger inlet 38. After the primary chiller water supply is conditioned within the second heat exchanger 28, it exits via a heat exchanger outlet 36, where it continues out to the water conduits 14.

The containment circuit 21 includes a compliant containment device 42 (i.e., an expansion tank). The compliant containment device 42 is used to accommodate the varying volume of the primary chiller water supply 30 within the cooling fluid loop 20 due to thermal expansion. The compliant containment device 42 accommodates the expanded primary chiller water supply 30 by further air compression and helps maintain a roughly constant pressure in the cooling fluid loop 20. In an embodiment, the compliant containment device 42 may be a vessel composed of metal. In some embodiments, the compliant containment device 42 may be a bladder-type vessel. In an embodiment, the compliant containment device 42 includes an insulating material disposed within or around the vessel.

The compliant containment device 42 includes an inlet 44 and an outlet 46 to allow the flow of a fluid 50 (e.g., water) therethrough. The inlet 44 is in fluid communication with the cooling fluid loop 20 via the heat exchanger outlet 36 and the outlet 46 is in fluid communication with the cooling fluid loop 20 via the pump inlet 34. The compliant containment device 42 further includes a valve 48 in fluid communication with either the inlet 42 or outlet 46. The valve 48 is configured to open and closed based in part on the temperature of the fluid 50 (e.g., water) within the compliant containment device 42. In an embodiment, the valve 48 includes a thermostatic valve. In another embodiment, the valve 48 may be controlled by a temperature sensing device and a solenoid.

The compliant containment device 42 of the present disclosure is configured to operate in freezing conditions without the need of a separate heater (e.g. an electrically driven heater). For example, the compliant containment device 42 of the present disclosure is configured to decrease the likelihood of the fluid 50 (e.g., water) within the compliant containment device 42 from freezing within the system because the fluid 50 is kept warmer by the temperature of the ambient air within the compliant containment device 42 due to the insulation material (not shown) within or around the compliant containment device 42.

Figure 3:
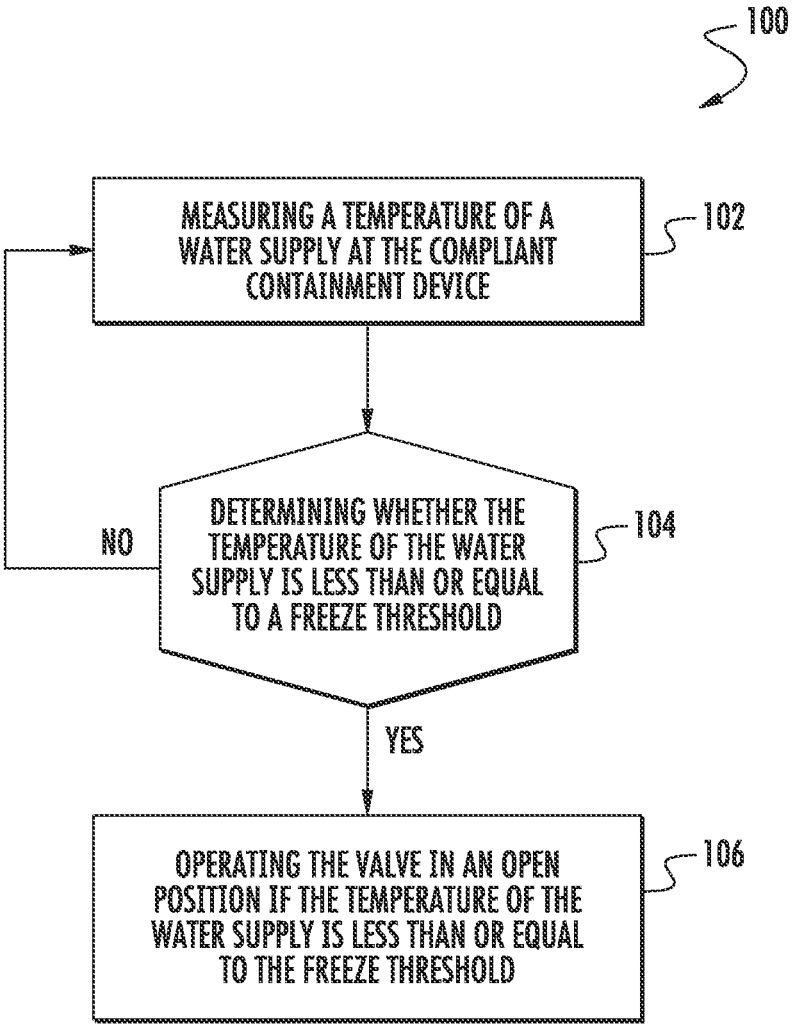
FIG. 3 illustrates a schematic flow diagram of a method of operating an expansion tank according to one embodiment of the present disclosure.

FIG. 3 illustrates an embodiment of a method of operating the compliant containment device 42 to prevent freezing of the primary chiller water supply within the cooling fluid loop 20. The method 100 includes step 102 of measuring a temperature of the primary chiller water supply. For example, if the valve 48 is a thermostatic valve located at the inlet 42, the valve 48 measures the temperature of the primary chiller water supply as it flows from the second heat exchanger 28 to the inlet 42.

The method 100 further includes step 104 of determining whether the measured temperature of the primary chiller water supply is less than or equal to a temperature threshold. In an embodiment, the temperature threshold is approximately 37 degrees Fahrenheit (approximately 3 degrees Celsius). It will be appreciated that the temperature threshold may be greater than or less than approximately 37 degrees Fahrenheit (approximately 3 degrees Celsius).

If the temperature of the primary chiller water supply is greater than the temperature threshold, the method returns to step 102 to measure the temperature of the primary chiller water supply. If the primary chiller water supply is less than the temperature threshold, there is a likelihood it could freeze and cause damage to the system; therefore, the valve 48 will open to allow the primary chiller water supply to flow through the compliant containment device 42. The fluid 50 (e.g., water) within the compliant containment device 42 is able to be warmed based on the temperature of the ambient air within the compliant containment device 42 and the insulation material (not shown) within or around the compliant containment device 42. Water flow is provided by the pressure difference between the loop upstream and downstream of the pumping device 32.

It will therefore be appreciated that the present disclosure provides an improved compliant containment device 42 to allow the flow of fluid 50 (e.g., water) within the compliant containment device 42 in the event that the temperature of the primary chiller water supply is less than or equal to the freeze threshold; thus reducing the need for additional material cost, assembly cost, and loss of efficiency.

While the disclosure has been illustrated and described in detail in the drawings and foregoing description, the same is to be considered as illustrative and not restrictive in character, it being understood that only certain embodiments have been shown and described and that all changes and modifications that come within the spirit of the disclosure are desired to be protected.

What is claimed is:

1. A chiller comprising:

a cooling fluid loop including a flow stream;

a containment circuit in fluid communication with the cooling fluid loop, the containment circuit comprising:

a compliant containment device comprising:

an inlet;

an outlet; and a containment volume in pressure communication with the flow stream, wherein the containment volume changes based in part on a pressure of the flow stream;

a valve in fluid communication with at least one of the inlet and the outlet, the valve configured to operate between an open and closed position based in part on the temperature of the flow stream;

a temperature sensing device in fluid communication with the inlet, the temperature sensing device configured to measure temperature data;

a solenoid operably coupled to the temperature sensing device and the valve;

wherein the solenoid is configured to operate the valve based in part on the temperature data.

2. The chiller of claim 1, wherein the compliant containment device further comprises an insulation material disposed in a location comprising at least one of within and around the compliant containment device.

3. The chiller of claim 1, wherein the cooling fluid loop comprises:

a pumping device configured to circulate the flow stream, the pumping device in fluid communication with the outlet; and a heat exchanger in fluid communication with the pumping device and the inlet.

4. A compliant containment device for use in a hydronic system, the compliant containment device comprising:

a vessel including an inlet and an outlet;

a valve operably coupled to at least one of the inlet and outlet, wherein the valve is configured to operate between an open and closed position based in part on a temperature;

a solenoid operably coupled to the valve; and a temperature sensing device operably coupled to the solenoid, the temperature sensing device configured to measure temperature data;

wherein the solenoid is configure to operate the valve based in part on the temperature data.

5. The compliant containment device of claim 4, further comprising insulation material disposed in a location comprising at least one of within and around the compliant containment device. insulation material disposed within or around the vessel.

6. The compliant containment device of claim 4, wherein the temperature comprises at least one of an ambient temperature and a temperature within a containment circuit flow stream.

7. A method of operating a compliant containment device in fluid communication with a cooling fluid loop, the compliant containment device comprising a vessel including an inlet, an outlet, a valve in fluid communication with at least one of the inlet and outlet and a solenoid operably coupled to the valve, the method comprising:

flowing a stream of water through the inlet and the outlet;

maintaining the stream of water above a temperature threshold;

wherein flowing the stream of water through the inlet and the outlet includes:

measuring a temperature of the stream of water at the compliant containment device;

determining whether the temperature of the stream of water is less than or equal to the temperature threshold; and operating the solenoid to place the valve in an open position if the temperature of the stream of water is less than or equal to the temperature threshold.

8. The method of claim 7, wherein the temperature threshold is approximately 37 degrees Fahrenheit.

* * * * *